United States Patent [19]

Hayes

[11] 3,983,532

[45] Sept. 28, 1976

[54] TRAFFIC CONTROL SIGNAL APPARATUS

[76] Inventor: Royce Hayes, 2785-A Shallowford Road, Chamblee, Ga. 30341

[22] Filed: Dec. 26, 1974

[21] Appl. No.: 536,343

Related U.S. Application Data

[63] Continuation-in-part of Ser. No. 441,638, Feb. 11, 1974, Pat. No. 3,870,991.

[52] U.S. Cl. ..... 340/41 R; 340/366 CA; 313/466

[51] Int. Cl.[2] ..... G08G 1/00

[58] Field of Search ..... 340/41 R, 366 CA; 313/466

[56] References Cited

UNITED STATES PATENTS 2,829,362 4/1958 Terrill ..... 340/41 A 3,870,991 3/1975 Hayes ..... 340/41 R

*Primary Examiner*—Thomas B. Habecker

*Attorney, Agent, or Firm*—Jones, Thomas & Askew

[57] ABSTRACT

Traffic signal apparatus utilizing a cathode ray tube to provide traffic control signals. The incandescent lamps and color filters associated with the conventional traffic control signal are replaced by a cathode ray tube and associated circuitry connected to emit desired traffic control signal colors, such as red, amber, and green. A characteristic traffic information indicium is also displayed on the cathode ray tube along with the color signal. Other signalling effects, such as directional control arrows, are also provided.

4 Claims, 6 Drawing Figures

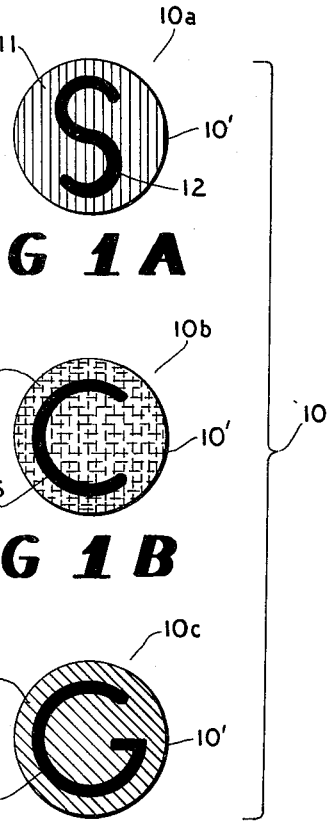
FIG 1A
FIG 1B
FIG 1C
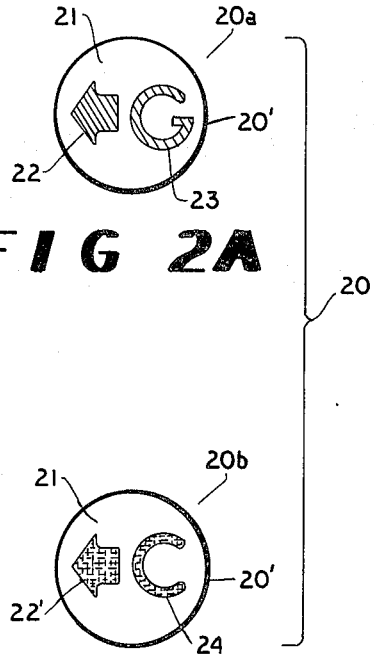
FIG 2A
FIG 2B
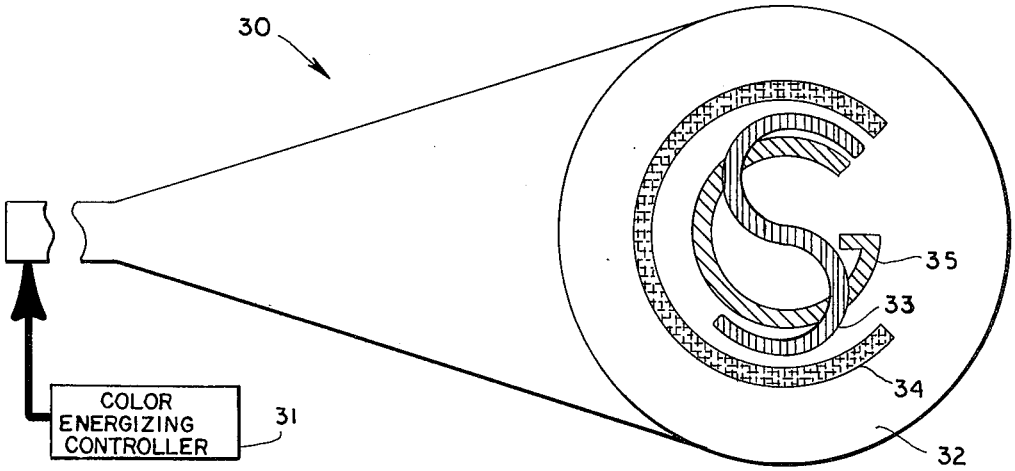
FIG 3

TRAFFIC CONTROL SIGNAL APPARATUS

This is a continuation-in-part of application Ser. No. 441,638 filed Feb. 11, 1974 and now U.S. Pat. No. 3,870,991.

This invention relates in general to signalling apparatus and in particular to a traffic control signal apparatus.

The control of vehicular and pedestrian traffic is almost universally accomplished by way of the well-known and conventional traffic control signal which consists of a separate signal unit comprising a lamp housing, reflector, lamp, and colored lens for each separate color signal, directional arrow, or other traffic control message. Each of the individual lamps is connected to a sequence controller in an operating circuit typically including a timing device and switching devices, so that the lamps are individually operated in a predetermined and repetitive sequence which provides a desired traffic control signal pattern. The basic concept of this type of conventional traffic control signal has been known and used for many years.

Notwithstanding the widespread acceptance of the conventional traffic control signal, these prior-art signals have several practical disadvantages. Since each desired type of signal, such as each of the three basic colors (red, amber, green), direction arrows, and the like requires a separate complete optical projection signal unit, a typical heavily-traveled urban intersection with special traffic control functions such as timed left-only or right-only times, along with the three basic traffic control signals, can require a composite traffic signal that may include eight or more separate signal units for each direction of traffic flow to be controlled. Furthermore, any change in the desired traffic control signal requires a change in at least the lens and/or color filter assembly of one or more signal units.

Since conventional traffic control signals use incandescent lamps, the intensity of illumination emanated by conventional traffic control signals is generally non-variable and necessarily represents a compromise of possibly different levels of optimum illumination which might be required during nighttime, during normal daytime operation, and during daytime operation at hours when ambient lighting conditions would tend to wash out the illumination from the signal.

Accordingly, it is an object of the present invention to provide an improved traffic control signal apparatus.

It is another object of the present invention to provide traffic control signal apparatus which can provide a plurality of control signals emanating from a single signal unit.

It is another object of the present invention to provide cathode ray tube traffic control signal apparatus which provides traffic control indicia along with traffic control colors.

Other objects and many of the attendant advantages of the present invention will become more readily apparent from the following description of preferred disclosed embodiments, including the drawing in which:

FIGS. 1A, 1B, and 1C show pictorial display views of traffic control signal display apparatus according to the disclosed embodiment of the present invention;

FIGS. 2A and 2B show pictorial display views of traffic control signal display apparatus according to another embodiment of the present invention; and FIG. 3 shows a schematic view of an embodiment of cathode ray tube useful in implementing the present invention.

Stated in general terms, the traffic control signal of the present invention comprises a cathode ray tube, referred to hereinafter by the term "CRT", of the type which selectively emits various colors in response to appropriate input control signals. A CRT is positioned so to display illumination which is observeable in a field of view including vehicular, pedestrian, and/or other desired traffic to be controlled, and the CRT is supplied with appropriate signals necessary to generate the desired illumination colors or other signals. The CRT also displays indicia in contrasting illumination patterns, with a unique indicium being displayed by the CRT for each selected traffic control color.

The present invention is more readily understood with reference to the disclosed embodiments as shown in the Figures. The several views of FIG. 1 show different traffic control information displays provided by a single CRT 10' according to the present invention, and so the several displays of FIGS. 1A–1C are collectively designated as CRT display 10. It will, accordingly, be understood that FIG. 1A shows a first traffic control display **10*a* in which a particular information display appears on the face of a CRT 10', FIG. 1B shows a second traffic control display 10*b* in which another information display appears on the face of the same CRT 10', and FIG. 1C shows yet another information display 10*c* appearing on the face of the same CRT 10'**.

It will be understood that the CRT 10' utilized in the CRT display 10 of FIGS. 1A–1C may be but one CRT utilized in traffic control signal apparatus for a multiple-way controlled intersection, for example, and that other separate traffic control signals embodying other similar CRTs may be required to provide control signal information along each of several paths and directions of travel. It will also be understood that the CRT 10' of the CRT display 10 must be provided with control yokes and associated circuitry necessary for operation of a CRT. Sweep circuits and associated interconnections with CRTs is conventional and is well-known to those skilled in the art. Particular details of CRTs as used in a traffic control environment are further described in the above-referenced U.S. Pat. No. 3,870,991.

The information display **10*a* of FIG. 1A provides a red field 11 on which is superimposed the black indicium 12. The indicium 12 is depicted in FIG. 1A as being the letter "S", corresponding to the "stop" traffic control information conventionally associated with and imparted by the color red on the field 11. The total effect of the information display 10*a* is, accordingly, the information conveyed by the color on the field 11 reinforced by the information conveyed by the indicium 12. It will be apparent, moreover, that color blind individuals will be immediately apprised of the traffic control information from seeing the indicium 12, without having to guess or speculate about the color of the field 11** on which the indicium appears. This latter consideration is especially important with CRT traffic control signals, inasmuch as the red-above-green positioning information usually associated with conventional three-color traffic control signals of the prior art is unavailable in a single-CRT traffic control signal.

Turning to the traffic control display **10*b* depicted in FIG. 1B, it is seen that the CRT 10' now exhibits and amber (or yellow) field 15 corrsponding to the "caution" traffic condition. The display 10***b* includes an indicium 16 in the shape of the letter "C" superimposed in black on the amber field 15. Similarly in FIG. 1C, the CRT 10' exhibits a traffic control display 10*c* including a green field 17 on which is superimposed the black indicium 18 in the form of the letter "G", identified with the "go" condition implied by the green field.

Since each of the indicia 10, 16, and 18 associated with the CRT display 10 of FIGS. 1A, 1C is approximately centrally disposed on the face of the CRT 10', it is apparent that these indicia overlap one another on the face of the CRT. Apparatus for obtaining overlapping indicia in multiple-color CRTs is described below with respect to FIG. 3. Since each indicium corresponds to a particular selected traffic control color in the disclosed embodiment, it is seen that no normal traffic control situation will arise wherein a particular CRT is required to simultaneously display more than one indicium.

FIGS. 2A and 2B show another CRT display 20, showing two alternative information displays 20*a* and 20*b* which can be made to appear on the face of a CRT 20'. Each of the information displays 20*a* and 20*b*, respectively depicted in FIGS. 2A and 2B, may have a field 21 of the same color, such as white, selected to provide color contrast for the indicia also displayed on the respective information displays. Information display 20*a*, by way of example, contains indicia including a directional arrow 22 and the indicium 23 consisting of letter "C". Both the arrow 22 and the indicium 23 shown on the information display 20*a* are preferably of a color, such as green, which contrasts with the color chosen for the background field 21. It will be understood that the information display 20*a* corresponds to a "go" left-turn traffic control condition.

Turning to FIG. 2B, the directional arrow is now designated as 22' and the indicium 24, consisting of the letter "C", replaces the previous indicium 23. Moreover, both the directional arrow 22' and the indicium 24 are of a color which is preferably different from the color of the corresponding elements shown on the information display 20*a;* the arrow 22' and the indicium 24 may, for example, be the caution color amber, denoting that the directional or other information signified by the arrow 22' is about to terminate. It is evident that the arrows 22 and 22' sequentially appear in mutually overlapping locations on the face of the CRT 20', as do the indicia 23 and 24. This overlapping relation of arrows (or other information) and indicia, as well as the overlapping relation previously discussed hereinabove with respect to the CRT display 10, while not a requirement of traffic signals according to the present invention, is a preferred arrangement which allows each separate indicium to occupy the same centralized prominant location on the information displays selectively presented on the CRT.

FIG. 3 shows a particular embodiment of CRT 30 which provides the combined and related color-indicia information according to the present invention. It is assumed for illustrative purposes that the CRT 30 is intended to provide the three separate traffic control displays 10*a*, 10*b*, and 10*c* depicted in FIGS. 1A–1C and discussed hereinabove. The CRT 30 may be of conventional external design and may be constructed according to three-color CRT design techniques known to those skilled in the art. The CRT 30 is connected to receive control signals provided by a color energizing controller 31, which is more fully shown and described with reference to FIG. 1 of the aforementioned U.S. Pat. No. 3,870,991.

Within the CRT 30, there is a three-color array of phosphors positioned adjacent the interior of the CRT face 32. The three-color phosphor array may comprise alternately-positioned phosphors of the three selected colors, in accordance with known CRT design, and the phosphors may be selected for direct production of the three traffic control colors desired to be provided by the CRT; the CRT 30 can have phosphors selected to produce red, green, and amber illumination on the CRT face 32. Since each of the indicia 12, 16, and 18 selectively appear on the face 32 in black, which is the absence of any illumination emanating from the CRT 30, each such indicium is provided in the CRT 30 by the absence of color phosphor in the particular color corresponding to the selected color of the display field which is desired to surround the particular indicium. Considering the indicium 12 which appears in FIG. 1A as the letter "S" defined in black surrounded by a red field 11, the indicium 12 is defined on the CRT 30 by the complete absence of red phosphor within the region 33 on the phosphor-bearing face of the CRT. The region 33 in FIG. 3 is color-marked to symbolize the phosphor color which is missing from such region. When the CRT 30 is operated in the customary manner to energize the red phosphor within the CRT, it will be understood that the absence of red phosphor throughout the region 33 causes such region to appear as the black letter "S" on the face of the CRT.

The indicium 16, which appears as the letter "C" in black surrounded by an amber background in FIG. 1B, is similarly provided by the region 34 on the phosphor-bearing face of the CRT, throughout which amber-producing phosphor is completely absent. The indicium 18 is likewise obtained in the CRT 30 by providing the region 35 on the phosphor-bearing face of the CRT, throughout which the green-producing phosphor is completely absent. It will be understood that operation of the CRT 30 to provide an amber color causes the letter "C" to appear in black as the indicium 16, surrounded by an abmer field on the face 32 of the CRT. The letter "G", corresponding to the indicium 18, is provided in a like manner when the CRT 30 is operated to emit a green color.

Although FIG. 3 shows an embodiment of CRT construction which is specifically designed and intended to provide the traffic control information depicted in FIGS. 1A–1C, it will be evident to those skilled in the art that corresponding techniques of CRT construction can be applied to provide the traffic control information displays of FIG. 2A and 2B, as well as other desired types of displays. It will also be understood that the blacked-out regions necessary to provide the desired indicia, concurrently with the corresponding particular color field, can alternatively be generated electronically by special-effects generators connected in circuit with the control signals from the color energizing controller 31. Such special-effects generators are well known to those skilled in the art of television, and need not be described in detail herein.

It will be understood that the foregoing refers only to disclosed preferred embodiments of the present invention, and that numerous alterations and modifications may be made therein without departing from the spirit and the scope of the invention as set forth in the following claims.

It will also be apparent that the present invention is not to be limited by the depiction of letters used as indicia in the above embodiments. Any desirable types of indicia, such as numerals or other symbols, can be provided in accordance with the present teachings.

What is claimed is:

1. Traffic control signal apparatus, comprising:

CRT means positioned in signal display relation to a traffic path;

said CRT means including separate sets of color phosphors corresponding to at least certain selected traffic control colors, and phosphor energizing means corresponding to said sets of phosphors and selectively operative for light-emitting energization of said corresponding phosphors;

one of said sets of phosphor being missing from a predetermined region which is configured to define a traffic signal indicium on said CRT means, so that energization of said one set of phsophor produces a particular color illumination surrounding and defining said indicium by the absence of said particular color illumination; and color energizing control means operatively connected to supply said phosphor energizing means of said CRT means with input signals to selectively energize certain ones of said traffic control colors.

2. Apparatus as in claim 1, wherein said CRT means includes a first set of color phosphor corresponding to a first traffic control color and disposed throughout a region which includes said predetermined region, and at least one other set of color phosphor for producing a color contrasting with said first traffic control color and disposed only outside of said predetermined region.

3. Apparatus as in claim 1, wherein said predetermined region where a particular one color phosphor set is missing is substantially less than the total area of said one color phosphor set, so that energization of said one color phosphor set provides a visible predetermined color output in addition to the visible indicia defined by the absence of said predetermined color illumination output in said predetermined region of missing phosphor.

4. Apparatus as in claim 1, wherein said phosphor energizing means comprises separate energizing means corresponding to each of said sets of color phosphors, and wherein said color energizing control means is operative to provide an input signal only to the energizing means corresponding to a desired selected color.

* * * * *